US005176466A

United States Patent [19]

Camfield

[11] Patent Number: 5,176,466

[45] Date of Patent: Jan. 5, 1993

[54] REVETMENT UNIT AND METHOD FOR PROTECTING SHORELINE OR WATERWAY

[75] Inventor: Frederick E. Camfield, Vicksburg, Miss.

[73] Assignee: The United States of America as represented by the Secretary of the Army, Fort Belvoir, Va.

[21] Appl. No.: 908,205

[22] Filed: Jul. 2, 1992

[51] Int. Cl.[5] ..... E02B 3/12

[52] U.S. Cl. ..... 405/16; 52/610; 404/34; 404/41; 404/42; 446/85

[58] Field of Search ..... 405/15-20, 405/284; 404/34, 36, 37-41; 52/610; 446/85

[56] References Cited

U.S. PATENT DOCUMENTS

| | | | |
|---|---|---|---|
| Re. 32,663 | 5/1988 | Atkinson | 405/16 X |
| 1,040,117 | 10/1912 | Bates | 404/42 X |
| 1,089,507 | 3/1914 | Smith | 52/610 |
| 3,990,247 | 11/1976 | Palmer | 405/16 |
| 4,326,817 | 4/1982 | Boiardi | 404/41 |
| 4,997,308 | 3/1991 | Welling | 404/38 |

FOREIGN PATENT DOCUMENTS

| | | | |
|---|---|---|---|
| 802715 | 2/1951 | Fed. Rep. of Germany | 52/610 |
| 2836980 | 3/1980 | Fed. Rep. of Germany | 404/41 |

*Primary Examiner*—Dennis L. Taylor
*Attorney, Agent, or Firm*—Darrell E. Hollis

[57] ABSTRACT

A revetment unit for protecting shoreline or waterway embankments from erosion comprising a generally L-shaped web having first and second arm portions converging at an apex and forming a 90° right angle. Each of the first and second arm portions terminate at end portions. Identical cylinder members are associated with the web and extend above and below the plane of the web. The cylinder members have a height substantially less than their width and a single cylinder member is positioned at each of the end portions and at the apex. The web has a width slightly less than the diameter of the cylinder members yet greater than the radius of the cylinder members. The end portion cylinders are equally spaced from the apex cylinder a distance between about 0.10 to about 0.25 of the diameter of the cylinders. The units are configured so that when at least five of the units are assembled in an interacted relation, at least three of the five will face in a direction opposite to that of the remaining two of the at least five units.

19 Claims, 1 Drawing Sheet

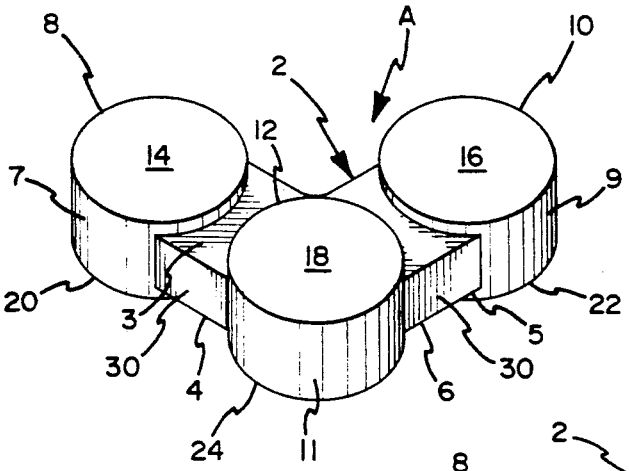
FIG. 1
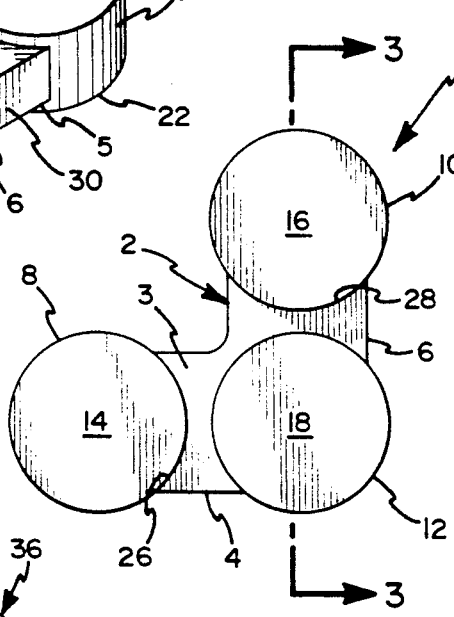
FIG. 2
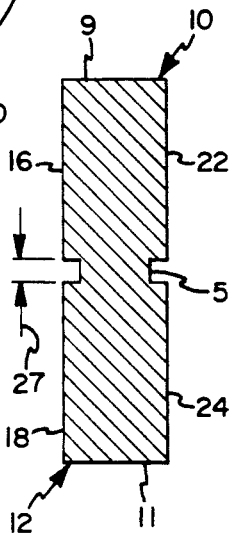
FIG. 3
FIG. 4
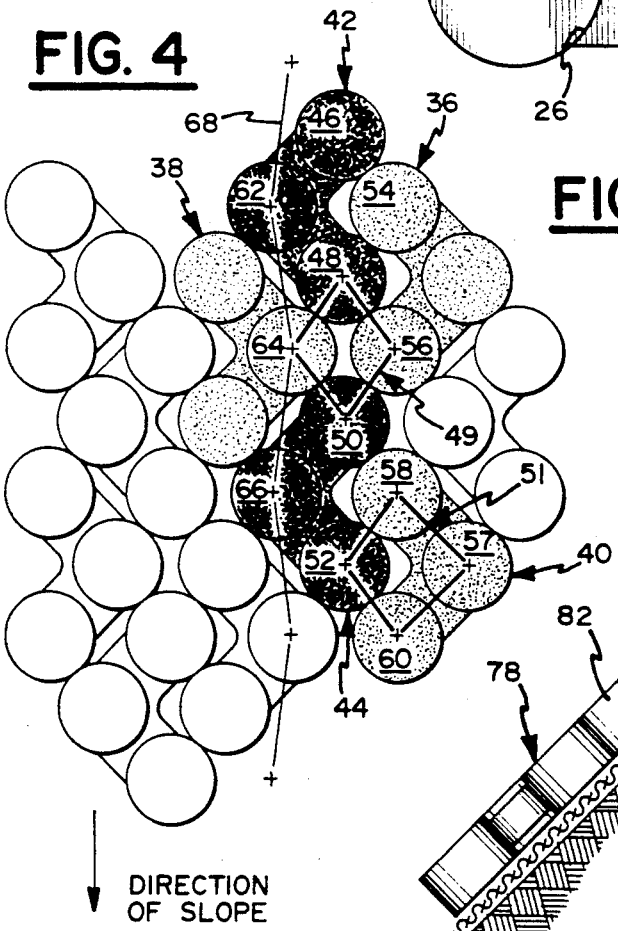
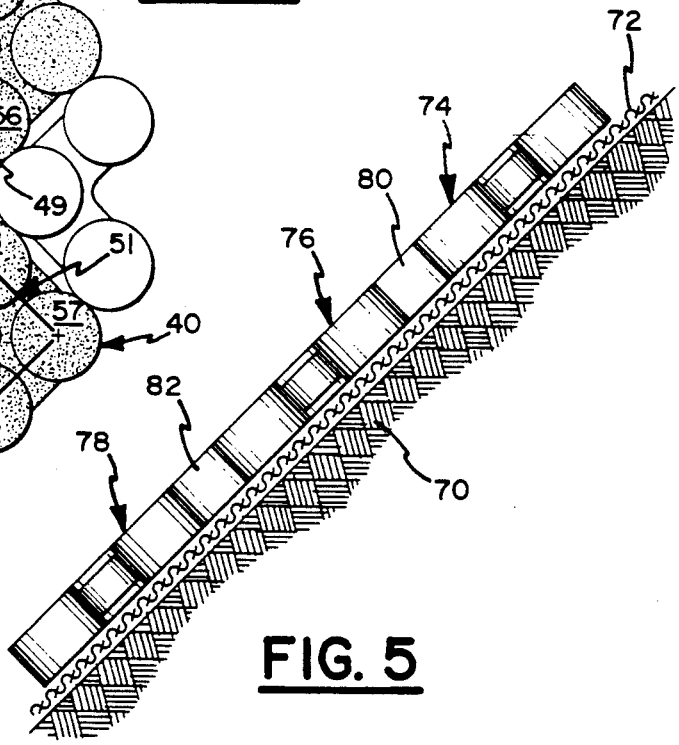
FIG. 5

REVETMENT UNIT AND METHOD FOR PROTECTING SHORELINE OR WATERWAY

FIELD OF THE INVENTION

The present invention relates to a device for the protection of shorelines or waterway embankments from erosion caused by water waves or currents and, more particularly, a revetment unit or element configured for interconnection with identical revetment units thereby providing an extensive matrix of shoreline protection.

BACKGROUND OF THE INVENTION

The erosion of sediment from shorelines and waterways is a longstanding problem common to beaches, lakeshore, riverbanks as well as canals and other artificial waterways. Wave action, currents and tides all tend to wear away and destroy shorelines. This destruction occurs either gradually, over long periods of time or suddenly as in the event of a strong storm or hurricane.

In view of the destructive effects such erosion has upon property values as well as public construction projects, a variety of approaches have been developed over the years to preserve shorelines and reduce the effects of erosion. Piers, jetties and breakwalls have all been employed in varying extents and with limited success.

When dealing with sloping banks and shorelines, revetment is a commonly used means for protection. The type of revetment used can vary from simply positioning closely laid stone or boulders along the bank to a more permanent and complex approach including the placement of prefabricated steel or concrete units along the shoreline.

More recently, revetment networks have been developed which provide a number of uniquely designed and similarly sized units or bodies of prefabricated concrete or other heavy material. The units are transported to a jobsite and placed in an interconnected manner to form a matrix network having enhanced cohesion and resistance to wave action.

Typical of such devices is U.S. Pat. No. 4,083,190 (Pey) which discloses a breakwater composed of a network of interconnected elements all of which have a similar size and configuration. Each element consists of a triangular or circular body with three posts extending from the body so that when plural bodies are arranged in layers, the posts interlink within the open portions of adjacent bodies to form a connected, protected network.

The prior art devices and in particular the unit as taught by the Pey patent fail to provide effective shoreline protection in a number of respects. The unit contains sharp corners, edges as well as projecting legs which make it more susceptible to breakage. In addition, the interlock arrangement provided by these units is rather loose fitting, relying upon posts to interfit oversized openings of the adjacent units. If a single post is broken the integrity and strength of the entire network is reduced. Further, units containing posts or legs have a relatively high center of gravity making them less stable and more prone to displacement by wave action or currents. The prior art revetment units are relatively complicated in design, making them expensive to manufacture.

Thus, a need has existed in the art for providing a revetment unit which is of a simple construction yet provides increased interlocking capabilities and enhanced resistance to wave action or currents.

OBJECTS AND SUMMARY OF THE INVENTION

It is therefore an object of the present invention to provide a revetment unit for protecting shoreline or waterway embankments from erosion which has a simplified design and enhanced interlocking capabilities when arranged with other identical units into a protective matrix covering.

An additional object of the present invention is to provide a revetment unit having a streamlined design and shape which provides less resistance to fluid contact and longer life.

Still a further object of the present invention is to provide a revetment unit having a low center of gravity and more stability once it is positioned along an embankment or shoreline.

A still further object of the present invention is to provide a revetment unit which can be readily cast and produced and is thus economical to manufacture.

Yet another object of the present invention is to provide a revetment unit which when interlocked with identical revetment units creates a matrix having selective spacing between the interlocked units reducing excessive fluid pressure build-up beneath the network of units.

Another object of the present invention is to provide a revetment unit having a simplified design which enables the unit to be manufactured in a wide variety of sizes and weights.

Yet another object of the present invention is to provide a method of arranging a series of revetment units into a protective matrix which can be done quickly and easily and with a minimum of expense.

These and other objects are achieved by providing a revetment unit for protecting shoreline or waterway embankments from erosion comprising a generally L-shaped web having first and second arm portions converging at an apex and forming a 90° right angle. Each of the first and second arm portions terminate at end portions. Identical cylinder members are associated with the web and extend above and below the plane of the web. The cylinder members have a height substantially less than their width and a single cylinder member is positioned at each of the end portions and at the apex. The web has a width slightly less than the diameter of the cylinder members yet greater than the radius of the cylinder members. The end portion cylinders are equally spaced from the apex cylinder a distance between about 0.10 to about 0.25 of the diameter of the cylinders. The units are configured so that when at least five of the units are assembled in an interacted relation, at least three of the five will face in a direction opposite to that of the remaining two of the at least five units.

The present invention also relates to a method for providing a protective covering against erosion of the shoreline or waterway comprising the steps of providing a number of identical units, each of which comprises an L-shaped web having first and second arm members converging at an apex and forming a 90° right angle. The arm portions terminate at end portions. Identical cylinder members having first and second surfaces are positioned at each of the end portions and at the apex. The web has a width slightly less than the diameter of the cylinder members. The end portion cylinders are equally spaced from the apex cylinder and at a distance between about 0.10 to about 0.25 the diameter of the cylinders. At least five of the units are placed on either their first or second surfaces against an embankment and assembled into an interacted relation so that at least three of the five will face in a direction opposite to that of the remaining two of the five units. The above steps are repeated with additional units until the embankment is sufficiently covered to protect it from erosion.

Additional objects, advantages and features of the present invention will become apparent from a consideration of the following specification taken in conjunction with the accompanying drawings.

BRIEF DESCRIPTION OF THE DRAWINGS

FIG. 1 is a perspective view of an individual revetment unit according to the present invention;

FIG. 2 is a top plan view of the revetment unit shown in FIG. 1;

FIG. 3 is a sectional view of the revetment unit shown in FIG. 2 and taken along lines 3—3;

FIG. 4 is a top plan view showing a number of revetment units in an interlinked arrangement for covering a shoreline or waterway embankment and including connecting lines illustrating the interrelation of the various identical cylinder members, and;

FIG. 5 is a side view showing a number of interconnected revetment units when positioned over a bedding material lying against an embankment of a shoreline or waterway slope.

DETAILED DESCRIPTION OF THE PREFERRED EMBODIMENT

Referring now to FIGS. 1 through 3, the revetment unit A according to the present invention can be seen as comprising a generally L-shaped web 2 having first arm portion 4 and second arm portion 6 converging at an apex and forming a 90° right angle. Integral with the L-shaped web 2 are identical cylinder members 8, 10 and 12 having a generally cylindrical shape and a height substantially less than a width (diameter). In a preferred embodiment, the width of the cylinder is twice that of its height.

As can be seen in the drawings, the cylinders 8, 10 and 12 generally have a uniform cylindrical shape and smooth surface along the perimeter of their respective sides 7, 9 and 11. Each of the identical cylinder members 8, 10 and 12 are provided with first or top surfaces 14, 16 and 18 respectively. In addition, each of the identical cylinder members 8, 10 and 12 are provided at their opposite ends with second or bottom surfaces 20, 22 and 24 respectively. All of the top surfaces 14, 16 and 18 as well as bottom surfaces 20, 22 and 24 are planar and uniform in both size and shape.

As best shown in FIG. 2, the first arm portion 4 and the second arm portion 6 terminate at end portions 26 and 28 respectively, at which are positioned identical cylinder member 8 and identical cylinder member 10 respectively. The cylinders members 8 and 10 extend in a longitudinal direction from the first end portion 26 and second end portion 28. Thus, identical cylinder members 8 and 10 are thus an extension of the effective length of L-shape web 2, the measured distance of which is equal to the diameter of the identical cylinder members 8 and 10.

As best shown in FIG. 1 and 3, all the identical cylinder members 8, 10 and 12 extend above the top surface 3 and below the bottom surface 5 of the L-shaped web 2. In addition, and as best shown by FIG. 2, the identical cylinder members 8 and 10 have a diameter greater than the width of the L-shaped web 2. As a result, the side surfaces 7 and 9 of each of the identical cylinder members 8 and 10 extend beyond the side surfaces 30 of the L-shaped web 2.

The height of each of the identical cylinder members 8, 10 and 12 is limited to no more than one half their diameter. This design results in an individual unit A possessing an overall low center of gravity having less likelihood of being overturned by wave action. Further, the cylindrical design lacks sharp edges or corners and is therefor less susceptible to damage when the unit is jarred or impacted.

Identical cylinder member 12 is positioned on and integral with the L-shaped web 2 at its "apex", the region where the first arm portion 4 and second arm portion 6 converge. As with identical cylinder members 8 and 10, the top 18 of identical cylinder member 12 extends above and the bottom 24 of identical cylinder member 12 extends below the L-shaped web 2. The identical cylinder member side surface 11 extends beyond the side surface 30 of the L-shaped web 2 thereby eliminating any sharp corners or edges.

The L-shaped web 2 must be thick enough not to sever or break while the unit A is in use. The preferred embodiment of the present invention provides an L-shaped web 2 having a width slightly less than the diameter of the cylinder members 8, 10 and 12 yet greater than the radius of the cylinder members 8, 10 and 12. Generally speaking, the web 2 has a height of about $\frac{1}{3}$ to about $\frac{2}{3}$ the height of the cylinder members 8, 10 and 12.

As best shown in FIGS. 2 and 3, cylinder members 8 and 10 which are positioned at the ends 26 and 28 of first arm portion 4 and second arm portion 6 are spaced equidistant from the apex cylinder member 12. This distance 27 is critical in as much as it directly affects the interlocking relationship of the units A when assembled into a matrix and as will be further explained below. The preferred distance 27 according to the present invention is between about 0.10 to about 0.25 of the diameter of the cylinder members 8, 10 and 12.

The distance 27 between the cylinders is critical for a second reason in that if the spacing between the cylinder member is too small, when the units A are interlocked as a network, excessive water pressure will build up below adjacent units. This pressure build-up tends to displace units from the network. If the spacing between the cylinder members is too large, the open area between the units A is too large, decreasing the coverage of the slope and tending to increase erosion of sediment form underneath the layer of revetment units. Either case, spacing too small or too large would lead to disruption of the integrity of the interconnections. Applicant has found that regardless of their sizes, the stability of interconnection between the units remains constant so long as the spacing distance 27 is kept within these parameters.

As best shown in FIG. 4, a number of individual revetment units A are interfitted in an abutting relation to create a network for covering a surface (not shown) to be protected. When at least five of the individual revetment units are assembled into this interacted relation, at least three of the five will face in a direction opposite to that of the remaining two of the five units. Thus, revetment units 36, 38 and 40 face in a direction opposite to that of revetment units 42 and 44.

In addition, the interacted arrangement of FIG. 4 is such that the end portion cylinders 46, 48, 50 and 52 of revetment units 42 and 44 respectively have their axes lying in a plane transverse to the top L-shaped web surface of each of the units 42 and 44. Similarly, the end portion cylinder members 54, 56, 58 and 60 of revetment units 36 and 40 respectively have their axes lying in a plane transverse to the web top surface of each of the units.

When interlocked in the above manner, apex cylinder members 62, 64 and 66 of revetment units 42, 38 and 44 respectively have their axes lying in a serpentine plane transverse to the axes of each L-shaped web top surface of units 42, 38 and 44 and as indicated via line 68.

As best shown in FIG. 4, the interconnected arrangement of the revetment units according to the present invention are also characterized by a unique open spacing arrangement between the various units. When any four of the cylinder members are in adjacent and/or abutting contact, their axes align in a vertical plane and form a trapezium or parallelogram defining an open region therein.

For example, the axes of end portion cylinder members 48, 50 and 56 along with apex cylinder member 64 of FIG. 4 create a parallelogram indicated by line 49. However, the axes of end portions cylinder members 52, 58 and 60 along with apex cylinder 57 create a trapezium indicated by line 51.

As noted earlier, these open regions between the adjacent cylinder members are sized to minimize excessive pressure differentials from developing beneath the interlocked units and at the same time provide maximum coverage of the slope, thereby preventing displacement of units from the network and reducing erosion of material from below the units. Thus, when a number of revetment units are interconnected as shown in FIG. 4, the resultant structure has sufficient strength to absorb the kinetic energy of wave action while minimizing erosion of the slope upon which the revetment units lie.

Turning now to FIG. 5, an interlocked arrangement of revetment units is shown in place and upon a waterway embankment or shoreline 70 with suitable bedding material or filter cloth 72 disposed beneath identical cylinder members 74, 76 and 78. The sides of apex portions 80 and 82 from succeeding individual cylinder members are also shown. The filter or bedding material 72 has sufficient porosity so as to allow the egress of water through the material while preventing erosion of soil and other particles from the embankment 70. As can be appreciated, the weight of the individual revetment units is sufficient to keep the bedding 72 in place.

The revetment units according to the present invention can be constructed from a variety of materials which are heavy, dense, not readily subject to breakage or wear and have a long life. Exemplary of such materials are concrete (either reinforced or unreinforced) or iron all of which meet these requirements. The units can be cast within a mold and in a variety of sizes. Individual units can be made in weights from several pounds to upwards one ton with no change in the ability to form and maintain interlock. Also, the design of the revetment unit is such that the lack of sharp corners and openings makes casting and production both economical and efficient.

While this invention has been described as having a preferred design, it is understood that it is capable of further modifications, uses and/or adaptations of the invention following in general the principle of the invention and including such departures from the present disclosure as come within the known or customary practice in the art to which the invention pertains and as may be applied to the central features hereinbefore set forth, and fall within the scope of the invention and of the limits of the appended claims.

I claim:

1. A revetment unit for protecting shoreline or waterway embankments from erosion comprising:

a) a generally L-shaped web having top and bottom surfaces and first and second arm portions converging at an apex and forming a 90° right angle;

b) each of said first and second arm portions terminating at end portions;

c) identical cylinder members associated with said web and extending above and below the plane of said web, said cylinder members having a height substantially less than its width;

d) one of said cylinder members positioned at each of said end portions and said apex;

e) said web having a width slightly less than the diameter of said cylinder members and greater than the radius of said cylinder members;

f) said end portion cylinders members equally spaced from said apex cylinder member a distance between about 0.10 to about 0.25 of the diameter of said cylinder member; and, g) said unit being configured so that when at least five of said units are assembled in an interacted relation, at least three of said five will face in a direction opposite to that of the remaining two of said at least five units.

2. A revetment unit as in claim 1 and wherein:

a) said end portion cylinder members of said remaining two of said at least five units have their axes lying in a plane transverse to said units L-shaped web top surface.

3. A revetment unit as in claim 2 and wherein:

a) said end portion cylinder members of only two of said three of said at least five units have their axes lying in a plane transverse to said units L-shaped web top surface.

4. A revetment unit as in claim 2 and wherein:

a) said apex cylinder members of three of said at least five units have their axes lying in a serpentine plane transverse to the axes of said units L-shaped web top surface.

5. A revetment unit as in claim 1 and wherein:

a) said units being configured so that when any four of said cylinder members are in abutting contact their axes form a trapezium or parallelogram having an open space therebetween.

6. A revetment unit as in claim 1 and wherein:

a) said cylinder members are integral with said web.

7. A revetment unit as in claim 1 and wherein:

a) said cylinder member width is about two times that of its height.

8. A revetment unit as recited in claim 1 and wherein:

a) said web having a height of about ⅓ to about 170 the height of said cylinder.

9. A revetment unit as recited in claim 1 and wherein:

a) each of said cylinder members has a uniform radius.

10. A revetment unit as recited in claim 1 and wherein:

a) said unit is made from cast concrete.

11. A revetment unit as recited in claim 1 and wherein:

a) said unit is made from cast iron.

12. A method for providing a protective covering against erosion of a shoreline or waterway embankment comprising the steps of:

a) providing a number of identical units, each of which comprises a generally L-shaped web having top and bottom surfaces and first and second arm members converging at an apex and forming a 90° right angle, said arm portions terminating at end portions, identical cylinder members having first and second surfaces, said cylinder members positioned at each of said end portions and at said apex, said web having a width slightly less than the diameter of said cylinder members, said end portions cylinder members equally spaced from said apex cylinder member at a distance between about 0.10 to about 0.25 of the diameter of said cylinders;

b) placing at least five of said units against an embankment surface;

c) assembling said at least five of said units into an interacted relation so that at least three of said five will face in a direction opposite to that of the remaining two of said at least five units; and, d) repeating the above steps with additional units until the embankment is sufficiently covered.

13. A method as recited in claim 12 and wherein:

a) said end portion cylinder members of said remaining two of said at least five units have their axes lying in a plane transverse to said units L-shaped web top surface.

14. A method as recited in claim 13 and wherein:

a) said end portions cylinder members of only two of said three of said at least five units have their axes lying in a plane transverse to said units L-shaped web top surface.

15. A method as recited in claim 13 and wherein:

a) said apex cylinder members of three of said at least five units have their axes lying in a serpentine plane transverse to the axes of said units L-shaped web top surface.

16. A method as recited in claim 12 and wherein:

a) said units assemble cylinder members are in abutting contact their axes form a trapezium or parallelogram having an open space therebetween.

17. A method as recited in claim 12 and further including the step of:

a) covering the embankment with a layer of bedding material prior to placing of said at least five of said units against the embankment.

18. A method as recited in claim 17 and wherein:

a) said bedding material is a sheet of woven filter material.

19. A method as recited in claim 12 and wherein:

a) said web has a height about one third to about two thirds the height of said cylinder members.

* * * * *